US011428495B2

(12) United States Patent
Blackstock

(10) Patent No.: US 11,428,495 B2
(45) Date of Patent: Aug. 30, 2022

(54) DEVICE AND SYSTEMS FOR A SEMI-AUTOMATIC CROSSBOW

(71) Applicant: Limin' Innovations LLC, Thomaston, GA (US)

(72) Inventor: Scott S. Blackstock, Thomaston, GA (US)

(73) Assignee: Limin' Innovations LLC, Thomaston, GA (US)

( * ) Notice: Subject to any disclaimer, the term of this patent is extended or adjusted under 35 U.S.C. 154(b) by 0 days.

(21) Appl. No.: 17/069,081

(22) Filed: Oct. 13, 2020

(65) Prior Publication Data

US 2022/0113106 A1 Apr. 14, 2022

(51) Int. Cl.
*F41B 5/12* (2006.01)
*F41B 5/14* (2006.01)

(52) U.S. Cl.
CPC ..... *F41B 5/126* (2013.01); *F41B 5/12* (2013.01); *F41B 5/1469* (2013.01)

(58) Field of Classification Search
CPC .. F41B 5/126; F41B 5/12; F41B 5/123; F41B 5/00; F41B 5/1469
USPC ..... 124/25, 25.5, 45, 48, 51.1, 86
See application file for complete search history.

(56) References Cited

U.S. PATENT DOCUMENTS

| | | | | | |
|---|---|---|---|---|---|
| 2,918,050 | A * | 12/1959 | Kopman | F41B 5/12 | 124/25 |
| 3,561,419 | A * | 2/1971 | Cucuzza, Sr. | F41B 5/12 | 124/25 |
| 4,662,345 | A * | 5/1987 | Stephens | F41A 9/70 | 124/25 |
| 5,115,795 | A * | 5/1992 | Farris | F41B 5/1469 | 124/25 |
| 9,261,322 | B1 * | 2/2016 | Conkel | F41B 7/006 | |
| 10,663,249 | B1 * | 5/2020 | Liu | F41B 5/126 | |
| 2012/0037138 | A1 * | 2/2012 | Huebl | F41B 11/60 | 124/56 |
| 2012/0222661 | A1 * | 9/2012 | Bednar | F41B 5/1469 | 124/25 |
| 2016/0018175 | A1 * | 1/2016 | Lallier | F41B 5/12 | 124/25.6 |
| 2016/0123693 | A1 * | 5/2016 | Wohleb | F41B 5/1469 | 124/25.6 |
| 2016/0273868 | A1 * | 9/2016 | Carroll, Jr. | F41B 5/12 | |
| 2018/0051954 | A1 * | 2/2018 | Yehle | F41B 5/10 | |
| 2018/0321011 | A1 * | 11/2018 | Yehle | F41B 5/1469 | |
| 2019/0033033 | A1 * | 1/2019 | Vergara | F41B 5/12 | |

* cited by examiner

*Primary Examiner* — John E Simms, Jr.
(74) *Attorney, Agent, or Firm* — Troutman Pepper Hamilton Sanders LLP; Korbin Blunck

(57) ABSTRACT

The disclosed technology includes a semi-automatic crossbow having a stock, a plurality of limbs, a drawstring, a bolt feeder, a barrel, a draw assembly, and a release. The draw assembly can be configured to automatically move the drawstring to a cocked position and the release can include a trigger and be configured to release the drawstring when the trigger is actuated. The disclosed technology can further include a truck configured to engage the drawstring and a bolt such that the bolt can be propelled forward by the truck when the drawstring is released by the release.

19 Claims, 4 Drawing Sheets

DEVICE AND SYSTEMS FOR A SEMI-AUTOMATIC CROSSBOW

FIELD OF TECHNOLOGY

The present disclosure relates generally to crossbows, and, more particularly, to semi-automatic crossbows.

BACKGROUND

Crossbows have been used as an effective weapon and hunting tool for centuries. Crossbows consist of a bow-like assembly mounted onto a frame (or stock). The bow-like assembly typically comprises one or more limbs that can be bent to create and store elastic energy until the user is ready to fire the crossbow. When the user is ready to fire the crossbow, the user can pull a trigger to release the elastic energy stored in the limbs and cause a drawstring to engage a bolt seated on the frame to project the bolt rapidly from the crossbow.

Generally, crossbows must be individually loaded and fired by manually drawing the drawstring to a firing or cocked position, placing a bolt on the frame, and pulling a trigger or otherwise releasing the drawstring. Because crossbows must be individually loaded and fired, most users who use the crossbow for hunting are unable to fire more than a single bolt at an animal before the animal moves out of range. Although a few crossbows with bolt magazines exist, these crossbow designs require the user to manually cock the drawstring which causes the user to remove the target from the sights of the crossbow before firing a subsequent bolt. Removing the target from the sights of the crossbow delays the user's ability to fire subsequent shots and causes the user to be less likely to fire an accurate shot. Furthermore, although some battery powered semi-automatic crossbows exist, the current designs tend to be bulky, noisy, and inefficient for hunting purposes.

Another drawback of many crossbow designs is that the crossbow frame incorporates a flight groove (or arrow track) rather than a barrel. If a bolt is seated improperly in the flight groove, the crossbow will be unable to fire an accurate shot. Furthermore, crossbows having a flight groove are typically unable to fire smaller bolts because the smaller bolts are more likely to leave the flight groove prematurely, resulting in further firing inaccuracies.

What is needed, therefore, is a crossbow having the capability of efficiently and automatically reloading and firing multiple bolts while also increasing the accuracy of bolts fired from the crossbow. These and other problems are addressed by the technology disclosed herein.

SUMMARY

The disclosed technology relates generally to crossbows, and, more particularly, to semi-automatic crossbows.

The disclosed technology can include a semi-automatic crossbow having a stock with a butt end and a fore end. Limbs can be attached to the stock proximate the fore end and the limbs can each have a proximal end connected to the stock and a distal end terminating at the tip. A drawstring can be connected to the limbs proximate the tip. The semi-automatic crossbow can also have a bolt feeder configured to receive a plurality of bolts and a barrel attached to the stock and that can direct a bolt from the bolt feeder toward a target. The semi-automatic crossbow can have a draw assembly that can automatically move the drawstring to a cocked position. Furthermore, the semi-automatic crossbow can have a release that has a trigger and can release the drawstring when the trigger is actuated. The semi-automatic crossbow can include a truck that can engage the drawstring and the bolt such that the bolt can be propelled forward by the truck when the drawstring is released by the release.

The barrel of the semi-automatic crossbow can include rifling that can cause the bolt to spin as the bolt is fired from the automatic crossbow. The barrel can also include a slot that can receive a fletching of the bolt and a channel configured to receive the truck so that the truck can slide along a length of the barrel.

The bolt feeder of the semi-automatic crossbow can be or include a revolving cylinder attached to the stock and having a plurality of revolving cylinder chambers. Each revolving cylinder chamber of the revolving cylinder can receive a bolt and have a revolving cylinder chamber channel. The revolving cylinder chamber channel can receive the truck such that the truck can pass through the revolving cylinder chamber. Furthermore, the revolving cylinder chamber channel can be configured to align with the channel of the barrel.

The truck of the semi-automatic crossbow can be connected to the drawstring such that when the drawstring is moved from a cocked position to a fired position, the drawstring transfers an elastic energy of the limbs to the truck and the truck transfers the elastic energy to the bolt.

The bolt feeder of the semi-automatic crossbow can be a revolving cylinder attached to the stock and having a plurality of revolving cylinder chambers. Each revolving cylinder chamber can receive a bolt. The revolving cylinder can automatically rotate a bolt into a firing position prior to the drawstring being released from the release. Each of the revolving cylinder chambers can include a revolving cylinder chamber channel that can receive the truck such that the truck can pass through the revolving cylinder chamber.

The bolt feeder can also be or include a bolt magazine that can be attached to the stock and configured to receive a plurality of bolts. The bolt magazine can direct a bolt to a chamber of the semi-automatic crossbow such that the truck can engage the bolt of the plurality of bolts.

The draw assembly of the semi-automatic crossbow can include an electric motor, a battery that can power the electric motor, and an actuator that can be actuated by the electric motor and engage the truck. The drawstring can be attached to the truck and the draw assembly can move the drawstring from a fired position to a cocked position by engaging the truck. The draw assembly can be configured to automatically move the drawstring from the fired position to the cocked position after the bolt has been fired from the semi-automatic crossbow.

The actuator can be or include a cable and a hook attached to the cable. The draw assembly can be configured to move the drawstring from the fired position to the cocked position by actuating the electric motor to move the cable and engage the truck with the hook to move drawstring to the cocked position.

The barrel of the semi-automatic crossbow can have a channel configured to receive the truck and the truck can be configured to slide along a length of the barrel. Furthermore, the hook can direct the truck through the channel of the barrel. The draw assembly can also operate in reverse to safely move the drawstring from the cocked position to the fired position.

The actuator can also be or include a screw and a nut that can move the drawstring from the fired position to the cocked position by rotating the screw to actuate the nut and engage the drawstring.

In some examples, the bolt can be or include a sabot round.

The release can include a clamp and the truck having a release interface. The clamp can engage the release interface when in a cocked position such that the truck can be prevented from moving to a fired position until the trigger of the release is actuated.

The semi-automatic crossbow can include an electronic safety and a mechanical safety that can both be configured to prevent movement of the truck. The electronic safety can be configured to automatically move from a firing position to a safety position after a predetermined length of time.

Additional features, functionalities, and applications of the disclosed technology are discussed herein in more detail.

BRIEF DESCRIPTION OF THE DRAWINGS

The accompanying drawings, which are incorporated in and constitute a part of this specification, illustrate multiple examples of the presently disclosed subject matter and serve to explain the principles of the presently disclosed subject matter. The drawings are not intended to limit the scope of the presently disclosed subject matter in any manner.

DETAILED DESCRIPTION

Figure 1A:
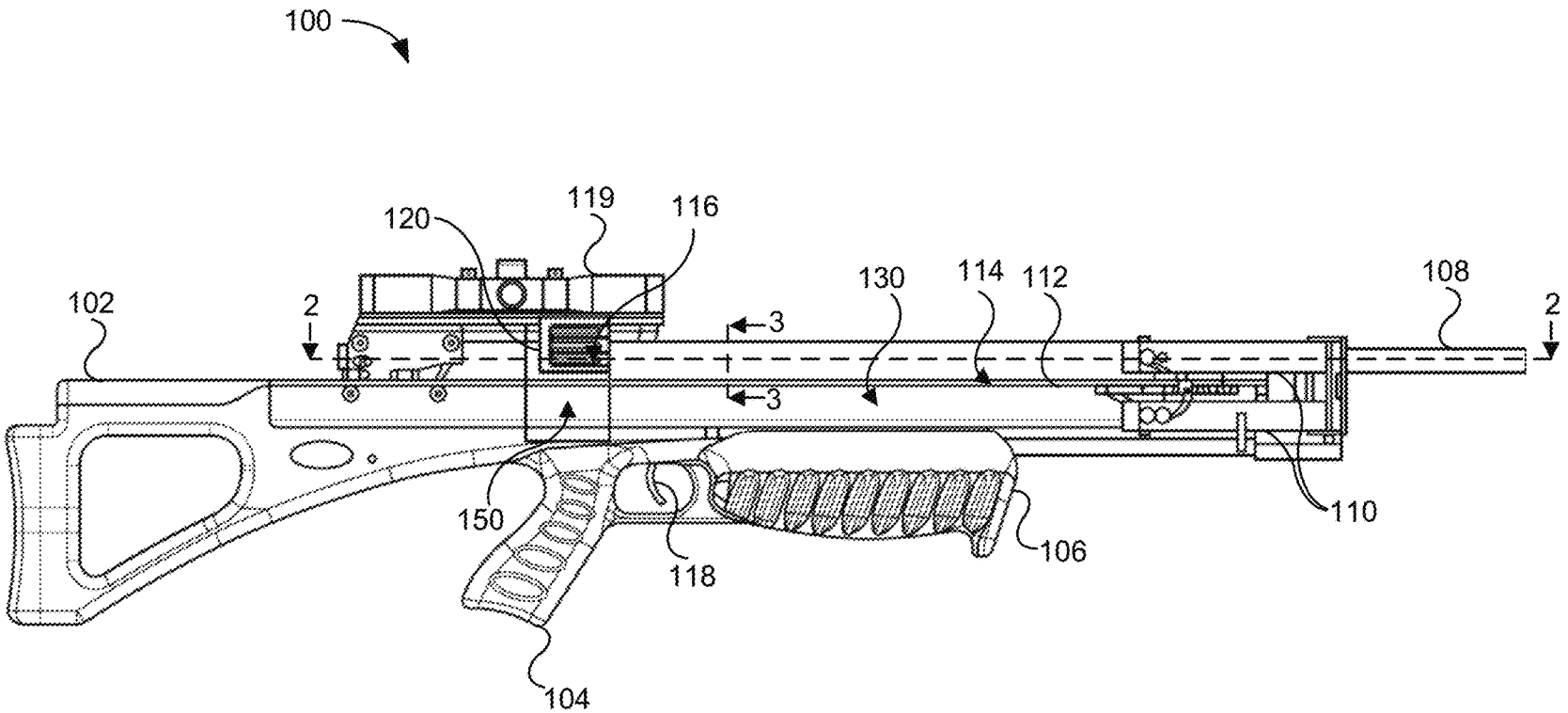
FIG. 1A illustrates a side view of a semi-automatic crossbow, in accordance with the disclosed technology.

The present disclosure relates generally to crossbows, and, more particularly, to semi-automatic crossbows. The disclosed technology, for example, can include a semi-automatic cross bow having a draw assembly that can automatically move a drawstring of the crossbow to a cocked position and move a bolt in a bolt feeder into a firing position. After firing the bolt from the crossbow, the draw assembly can automatically reload the crossbow by once again moving the drawstring to the cocked position and another bolt into the firing position. In this way, the crossbow of the disclosed technology can facilitate a user being able to rapidly fire multiple shots before needing to reload. As discussed in greater detail herein, the disclosed technology can include additional features that can increase the accuracy of a bolt fired from the crossbow and facilitate efficient reloading of the crossbow.

Although certain examples of the disclosed technology are explained in detail, it is to be understood that other examples, embodiments, and implementations of the disclosed technology are contemplated. Accordingly, it is not intended that the disclosed technology is limited in its scope to the details of construction and arrangement of components set forth in the following description or illustrated in the drawings. The disclosed technology can be implemented in a variety of examples and can be practiced or carried out in various ways. In particular, the presently disclosed subject matter is described in the context of being a crossbow used for hunting or target practice. The present disclosure, however, is not so limited, and can be applicable in other contexts. The present disclosure, for example and not limitation, can be used in military, defense, fishing, scientific, or other applications. Such implementations and applications are contemplated within the scope of the present disclosure. Accordingly, when the present disclosure is described in the context of being a crossbow used for hunting or target practice, it will be understood that other implementations can take the place of those referred to. Furthermore, although depicted in the figures and described herein as being a crossbow sized for hunting or target practice, the disclosed technology is not so limited and can include smaller and larger crossbows. For example, the disclosed technology can include smaller crossbows about the size of a handgun or pistol and larger crossbows that require a mount or stand such as crossbows designed to be mounted to a building, a platform, or a vehicle (e.g., a truck, a boat, a helicopter, etc.).

It should also be noted that, as used in the specification and the appended claims, the singular forms "a," "an," and "the" include plural references unless the context clearly dictates otherwise. References to a composition containing "a" constituent is intended to include other constituents in addition to the one named.

Also, in describing the examples, terminology will be resorted to for the sake of clarity. It is intended that each term contemplates its broadest meaning as understood by those skilled in the art and includes all technical equivalents which operate in a similar manner to accomplish a similar purpose.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

The components described hereinafter as making up various elements of the disclosed technology are intended to be illustrative and not restrictive. Many suitable components that would perform the same or similar functions as the components described herein are intended to be embraced within the scope of the disclosed technology. Such other components not described herein can include, but are not limited to, for example, similar components that are developed after development of the presently disclosed subject matter. Furthermore, unless explicitly stated otherwise, the various components of the described technology can be made from any suitable material including various metals, plastics, composite materials, wood, or any combination thereof. Similarly, unless explicitly stated otherwise, the various components of the described technology can be made using any suitable manufacturing process.

As will be appreciated by one of skill in the art, the term "semi-automatic" as used herein refers to the ability of the disclosed crossbow technology to automatically reload the crossbow after firing a bolt from the crossbow. In this way, a user can fire a bolt from the semi-automatic crossbow and fire a subsequent bolt from the semi-automatic crossbow without being required to manually reload the semi-automatic crossbow. Although described as a semi-automatic crossbow, the disclosed technology is not so limited and can be applied to single-shot crossbows and fully automatic crossbows. Furthermore, the terms "cocked position" and/or "firing position" as used herein refer to a position of the various components of the semi-automatic crossbow when the semi-automatic crossbow is capable of being fired with or without a bolt. Similarly, the term "fired position" as used herein refers to a position of the various components of the semi-automatic crossbow when the semi-automatic crossbow is not capable of being fired, with or without a safety applied (i.e., when the limbs are not drawn back).

Referring now to the drawings, in which like numerals represent like elements, examples of the present disclosure are herein described. FIG. 1A illustrates a side view of a semi-automatic crossbow 100, in accordance with the disclosed technology. The semi-automatic crossbow 100 can include a stock 102, a handle grip 104, and a foregrip 106. The stock 102, handle grip 104, and foregrip 106 can each be sized and shaped to increase a user's comfort while using the semi-automatic crossbow 100. For example, the stock 102, handle grip 104, and foregrip 106 can be ergonomically designed to conform to a user's body while using the semi-automatic crossbow 100. Furthermore, by being ergonomically designed, the stock 102, the handle grip 104, and the foregrip 106 can additionally help to increase a user's firing accuracy with the semi-automatic crossbow 100.

The stock 102, handle grip 104, and foregrip 106 can each be designed to support a barrel 108. The barrel 108 can be mounted proximate an upper portion of the semi-automatic crossbow 100 and be designed to receive and direct a bolt fired from the semi-automatic crossbow 100. The barrel 108, as will be described in greater detail herein, can be configured to guide a bolt of the semi-automatic crossbow 100 to more accurately fire toward a target than crossbows which only comprise an arrow track. The barrel 108 can include rifling and/or slots configured to cause a bolt of the semi-automatic crossbow 100 to spin along the bolt's longitudinal axis as it is directed from the barrel 108. In this way, the barrel 108 can cause the bolt to travel toward a target following a more stable, predictable, and accurate flight path. Furthermore, as will be appreciated by one of skill in the art, by incorporating a barrel 108, especially a barrel 108 having rifling and/or slots, the disclosed technology can facilitate use of bolts having a shorter length than would normally be capable with a traditional crossbow. By utilizing shorter bolts, the semi-automatic crossbow 100 can also fire bolts at a higher velocity, increasing the range and the effectiveness of the semi-automatic crossbow 100.

The semi-automatic crossbow 100 can include one or more limbs 110 that can be attached to a drawstring 112. As will be appreciated by one of skill in the art, the limbs 110 can be made from material that can be elastically deformed to create elastic potential energy. The limbs 110 can transfer the elastic energy to the drawstring 112 which can, in turn, transfer the elastic energy to a bolt to fire the bolt from the semi-automatic crossbow 100. The limbs 110 can be any suitable type of limb and can be sized for various applications. For example, the limbs 110 can be configured to have a draw weight that would be suitable for the particular application. In some examples, the semi-automatic crossbow 100 can have a draw weight ranging between about 150 lbs. to about 250 lbs. for various hunting applications. In other examples, the draw weight can be less than 150 lbs. or greater than 250 lbs. depending on the particular application.

The drawstring 112 can be configured to slide or otherwise move within a horizontal channel 114 that can be aligned beneath the barrel 108 and extend along the length of the barrel 108. As will be described in greater detail herein, the horizontal channel 114 can help to guide the drawstring 112 along the length of the barrel 108 and attach to additional components to transfer the elastic energy from the limbs 110 to a bolt of the semi-automatic crossbow 100.

The semi-automatic crossbow 100 can include a trigger 118 that can be configured to be actuated by a user to fire a bolt from the semi-automatic crossbow 100. As will be appreciated, the trigger 118 can be sized, positioned, and configured such that a user can easily access the trigger 118 and actuate the trigger when desired. Furthermore, the trigger 118 can be in mechanical communication with, or be a part of, a release assembly 150. The release assembly 150, as will be described in greater detail herein, can be configured to hold the drawstring 112 in a cocked position and release the drawstring 112 such that the drawstring 112 moves from the cocked position to a fired position to transfer energy from the limbs 110 to the bolt.

The semi-automatic crossbow 100 can include a sight 119 mounted to a top portion of the stock 102. The sight 119 can be any suitable type of sight for the application. For example, the sight 119 can be a fixed pin sight, a moveable pin sight, a pendulum sight, a target sight, an open sight, an aperture sight, a red dot sight, a laser sight, a telescopic sight (scope), or any other type of sight 119 as would be suitable for the particular application. Furthermore, the sight 119 can be or include a camera or other video or audio recording device.

The semi-automatic crossbow 100 can include a bolt feeder 120 configured to hold multiple bolts and direct the bolts to a chamber 116 such that the semi-automatic crossbow 100 can rapidly load a bolt into the chamber 116 between shots. The bolt feeder 120, for example and as will be described in greater detail herein, can be or include a magazine or a revolving cylinder configured to hold multiple bolts.

The semi-automatic crossbow 100 can include a draw assembly 130 configured to automatically move the drawstring 112 from a fired position to a cocked position. In other words, the draw assembly 130 can be configured to draw the drawstring of the semi-automatic crossbow 100 from a position where the limbs 110 provide little or no elastic energy to the drawstring 112 to a position where the limbs 110 are able to provide elastic energy to the drawstring 112 such that the semi-automatic crossbow 100 can be ready to fire when desired. Thus, the draw assembly 130 can make it possible for a user to rapidly fire multiple shots without needing to reload or cock the crossbow.

Figure 1B:
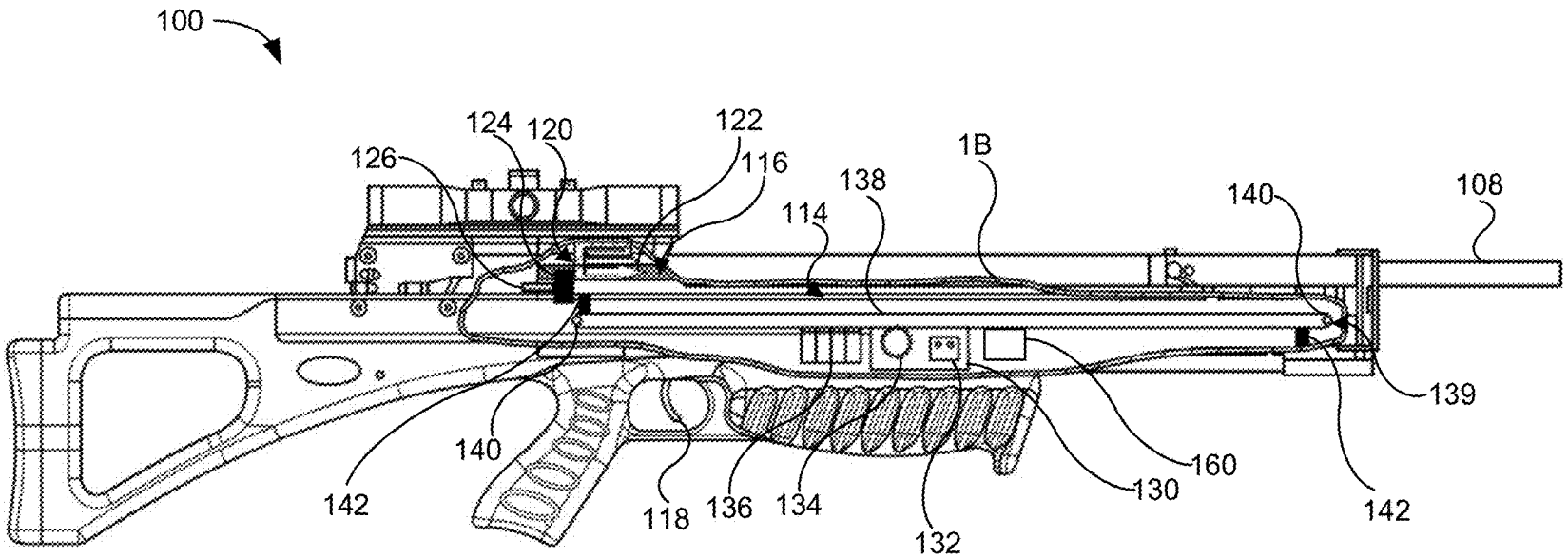
FIG. 1B illustrates a side section view of a semi-automatic crossbow taken along cutaway line 1B of FIG. 1B, in accordance with the disclosed technology.

FIG. 1B illustrates a side section view of the semi-automatic crossbow 100 taken along cutaway line 1B of FIG. 1B, in accordance with the disclosed technology. As depicted in FIG. 1B, the bolt feeder 120 can be positioned in the semi-automatic crossbow 100 such that a bolt 122 can be delivered from the bolt feeder 120 into the chamber 116. As will be appreciated, if the bolt feeder 120 is a revolving cylinder, the revolving cylinder can be positioned such that a chamber of the revolving cylinder can be positioned in the chamber 116 of the semi-automatic crossbow 100 to align a bolt 122 with the barrel 108 and be ready to fire. Alternatively, if the bolt feeder 120 is a magazine, the magazine can be positioned such that a bolt 122 can be directed to the chamber 116 and the bolt 122 can align with the barrel 108 and be ready to fire. In the example depicted in FIG. 1B, the bolt feeder 120 can be a revolving cylinder having multiple chambers configured to house a bolt 122 and positioned proximate the top of semi-automatic crossbow 100. Furthermore, the revolving cylinder can be configured such that a bottom chamber can be aligned with the chamber 116 and the barrel 108 to position the bolt 122 in a firing position.

The bolt 122 can be any type of bolt that would be suitable for the particular application. For example, the bolt 122 can be an arrow or dart having a shaft, fletching, point, and nock. If the bolt 122 is an arrow or dart, the shaft can be any suitable length and made of any suitable material for the semi-automatic crossbow 100. The arrow or dart can also have any suitable number of fletches (e.g., 1 fletch, 2 fletches, 3 fletches, 4 fletches, etc.) and have any suitable type of point (e.g., a field point, a broadhead point, a judo point, a blunt point, a fishing point, a bullet point, an explosive point, etc.). Alternatively, or in addition, the bolt 122 can be a sabot round. If the bolt 122 is a sabot round, the bolt 122 can be slug sabot, an explosive sabot, a shot pellet sabot, or any other suitable type of sabot round.

The semi-automatic crossbow 100 can include a truck 124 configured to slide along the horizontal channel 114 positioned parallel to the barrel 108. The horizontal channel 114 can be a simple slot, groove, or gap configured to receive the truck 124. The truck 124 can be attached to the drawstring 112 such that the drawstring 112 can transfer elastic energy from the limbs 110 to the truck 124. The truck 124 can be positioned within the horizontal channel 114 such that a portion of the truck 124 can extend into the barrel 108 and the chamber 116. By extending into the barrel 108 and the chamber 116, the truck 124 can be configured to engage the bolt 122 and transfer the elastic energy from the limbs 110 to the bolt 122 along much of the length of the barrel 108.

The truck 124 can be made of metal, graphite, composite materials, or any other suitable material for the application. Furthermore, the truck 124 can be made from a combination of materials. For example, the truck 124 can be made primarily from a light-weight material and lined with wear resistant material such that the truck can remain light but still be resistant to the wear that is likely to be exhibited after repeatedly sliding along the horizontal channel 114.

The semi-automatic crossbow 100 can include a release 126 configured to engage the truck 124 when in a cocked position such that the truck 124 is maintained in the cocked position. For example, the release 126 can include jaws or a clip configured to grab the truck 124 and maintain the truck 124 in the cocked position. In other examples, the release 126 can be a latch, lever, or other similar device configured to prevent movement of the truck 124 when in cocked position. Furthermore, no matter the configuration, the release 126 can be configured to be actuated by the trigger 118 such that the trigger 118 can cause the release 126 to release the truck 124 and cause the bolt 122 to be projected from the barrel 108. For example, if the release includes jaws or a clip, the jaws or clip can be opened to allow the truck 124 to be propelled forward through the barrel 108. Alternatively, if the release is a latch or lever, the trigger 118 can cause the latch or lever to move from a cocked position to a fired position such that the latch or lever allows the truck 124 to be propelled forward through the barrel 108.

The truck 124 can be moved from the fired position to the cocked position by the draw assembly 130. In some examples, and as illustrated in FIG. 1B, the draw assembly 130 can include an electric motor 132, a drive 134, a battery 136, and an actuator 139. In some examples, the actuator 139 can include a drive cable 138, one or more sprockets 140, and a hook 142. Alternatively, or in addition, the draw assembly 130 can include actuator 139 that comprises a screw or threaded rod and a nut configured to engage the truck 124 and move the truck 124 from the fired position to the cocked position when the screw or threaded rod is rotated by the drive 134.

In the example depicted in FIG. 1B, the draw assembly 130 can be configured to actuate the drive cable 138 by powering the electric motor 132 with the battery 136 to actuate the drive 134 and move the drive cable 138. Actuating the drive cable 138 can include moving the drive cable 138 around the one or more sprockets 140 to move the hook 142. The hook 142 can be configured to engage with the truck 124 such that the hook 142 can move the truck 124 from the fired position to the cocked position. As an example, the hook 142 can be configured to push the truck 124 along the horizontal channel 114. Since the truck 124 is attached to the drawstring 112, as the hook 142 pushes the truck 124 along the horizontal channel 114 to the cocked position, the truck 124 also moves the drawstring 112 to the cocked position.

As the truck 124 reaches the cocked position, the release 126 can engage the truck 124 such that the truck 124 is maintained in the cocked position as previously described. Furthermore, as the truck 124 reaches the cocked position, the hook 142 can push the truck 124 further along the horizontal channel 114 such that the hook 142 is able to continue to rotate along the drive cable 138 and around the sprocket 140 and out of the way of the truck 124. By continuing to move along the drive cable 138 and around the sprocket 140, the hook 142 can be moved out of the way of the truck 124 such that the truck 124 is free to move along the horizontal channel 114 without obstruction from the hook 142. In some examples, the horizontal channel 114 can be configured to turn upward proximate a rear end of the channel such that when the truck 124 reaches the cocked position, the truck 124 can be moved upward to allow the hook 142 to rotate around the sprocket 140 and out of the way.

The truck 124 can be further configured to actuate the bolt feeder 120 such that the truck 124 causes the bolt feeder 120 to position a bolt 122 into the chamber 116 as the truck 124 reaches the cocked position. In this way, the truck 124 can pass through the horizontal channel 114 along the barrel 108 and the chamber 116 without being obstructed by a bolt 122. In the example depicted in FIG. 1B, the bolt feeder 120 can be a revolving cylinder that is configured to rotate a chamber of the revolving cylinder having a bolt 122 into alignment with the chamber 116 such that the bolt 122 is moved into the firing position. For example, as the truck 124 is pushed back through the chamber 116 by the hook 142, the truck 124 can engage the rotating cylinder to rotate the cylinder such that a bolt 122 is aligned with the chamber 116 and the barrel 108. In this way, draw assembly 130 can cause the semi-automatic crossbow 100 to automatically move from a fired position to a cocked position.

The draw assembly 130 can be further configured to move in reverse to allow a user to unload the semi-automatic crossbow 100. For example, the draw assembly 130 can be configured to run in reverse such that the truck 124 can be moved from the cocked position to the fired position. In this way, the draw assembly 130 can be configured to be safely unloaded if a user cocks the semi-automatic crossbow 100 but later decides to not fire the semi-automatic crossbow 100.

The electric motor 132 can be any electric motor 132 sized and configured to actuate the drive 134 and cause the truck 124 to move from the fired position to the cocked position. For example, the electric motor 132 can be a brushed motor, a brushless motor, a direct drive motor, a linear motor, a servo motor, a stepper motor, etc. Furthermore, as will be appreciated, the electric motor 132 can be configured to be powered by the battery 136 by receiving direct current power from the battery 136.

The drive 134 can be a gear system or transmission system configured to be actuated by the electric motor 132 and, in turn, actuate the drive cable 138. As will be appreciated, the drive 134 can be configured to withstand the stress transferred from the limbs 110, to the drawstring 112, to truck 124, to the drive cable 138 and to the drive 134. In some examples, the drive 134 can be configured with multiple gears configured to reduce the stress transferred from the limbs 110 to the electric motor 132. Although depicted as being located proximate a middle of the drive cable 138, the drive 134 can be positioned proximate an end of the drive cable 138 and can be configured to engage a sprocket 140 directly or replace a sprocket 140 altogether.

The battery 136 can be any type of battery suitable for the particular application. The battery 136 can be an onboard battery that can be charged directly inside of the semi-automatic crossbow 100 or the battery 136 can be a rechargeable battery that can be removed from the semi-automatic crossbow 100. Furthermore, the battery 136 can be a single battery or the battery 136 can be multiple batteries configured to deliver sufficient power to the electric motor 132. In some examples, the battery can be a nickel-cadmium or lithium ion battery and have a capacity of 20 volts, 40 volts, 80 volts, etc. The battery 136 can be configured to power components of the semi-automatic crossbow 100 other than the electric motor 132. For example, the battery 136 can also be configured to power the sight 119 if the sight 119 is, for example, a powered scope, camera, range finder, or other electronic device.

Although described as a cable, the drive cable 138 can be a cable, a cord, a chain, a belt, a rope or any other similar type of device configured to be actuated by the drive 134 and rotate around the sprocket 140. Furthermore, the hook 142 can be a tooth, rod, lever, or other type of engagement device connected to the drive cable 138 and configured to push or otherwise engage the truck 124 in the horizontal channel 114. Furthermore, although depicted as having two hooks 142 attached to the drive cable 138, the drive cable can have a single hook 142 or have multiple hooks 142 as would be suitable for the particular application.

The semi-automatic crossbow 100 can have a controller 160 configured to control the operation of the draw assembly 130. For example, the controller 160 can be configured to determine when the semi-automatic crossbow 100 has been fired as indicated by an input received from a sensor or a signal generated by actuating the trigger. Furthermore, the controller 160 can be configured to receive an input from a user to cause the draw assembly 130 to cock or unload the semi-automatic crossbow 100. For example, after a user fires the semi-automatic crossbow 100, the controller 160 can determine that the semi-automatic crossbow 100 has been fired and that the draw assembly 130 should be actuated to reload the semi-automatic crossbow 100. As another example, a user can push a button to cause the controller 160 to initiate the electric motor 132 and move the truck 124 to the cocked position. Similarly, a user can push either the same button or a second button to cause the controller 160 to initiate the electric motor 132 to operate in reverse and move the truck 124 to the fired position.

Figure 1C:
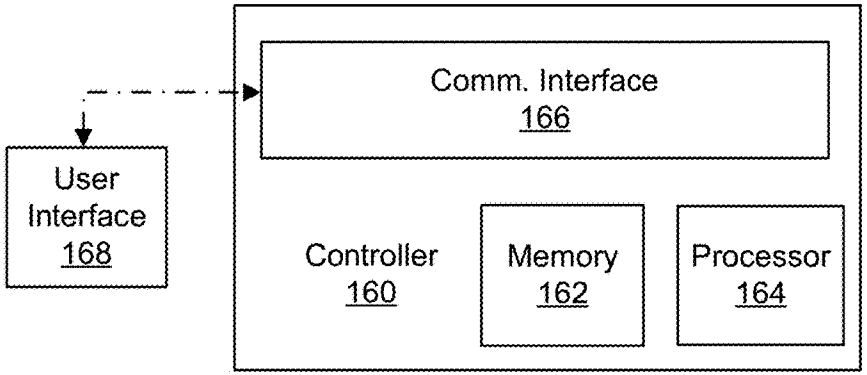
FIG. 1C illustrates a block diagram of a controller of a semi-automatic crossbow, in accordance with the disclosed technology.

FIG. 1C illustrates a block diagram of the controller 160, in accordance with the disclosed technology. The controller 160 can have a memory 162, a processor 164, and a communication interface 166. The controller 160 can be a computing device configured to receive data, determine actions based on the received data, and output a control signal to the electric motor 132. One of skill in the art will appreciate that the controller 160 can be installed in any location, provided the controller 160 is in electrical communication with the electric motor 132. Furthermore, the controller 160 can be configured to send and receive wireless or wired signals and the signals can be analog or digital signals. The wireless signals can include Bluetooth™, BLE, WiFi™ ZigBee™, infrared, microwave radio, or any other type of wireless communication as may be suitable for the particular application.

The controller 160 can include a memory 162 that can store a program and/or instructions associated with the functions and methods described herein and can include one or more processors 164 configured to execute the program and/or instructions. The memory 162 can include one or more suitable types of memory (e.g., volatile or non-volatile memory, random access memory (RAM), read only memory (ROM), programmable read-only memory (PROM), erasable programmable read-only memory (EPROM), electrically erasable programmable read-only memory (EEPROM), magnetic disks, optical disks, floppy disks, hard disks, removable cartridges, flash memory, a redundant array of independent disks (RAID), and the like) for storing files including the operating system, application programs (including, for example, a web browser application, a widget or gadget engine, and or other applications, as necessary), executable instructions and data. One, some, or all of the processing techniques or methods described herein can be implemented as a combination of executable instructions and data within the memory.

The controller 160 can also have a communication interface 166 for sending and receiving communication signals between the various components. Communication interface 166 can include hardware, firmware, and/or software that allows the processor(s) 164 to communicate with the other components via wired or wireless networks, whether local or wide area, private or public, as known in the art. Communication interface 166 can also provide access to a cellular network, the Internet, a local area network, or another wide-area network as suitable for the particular application. In this way, the semi-automatic crossbow 100, for example, can communicate with a server or other device to receive periodic updates to the controller 160. For example, the semi-automatic crossbow 100 can be configured to receive software updates from a server such that the semi-automatic crossbow 100 can be remotely updated.

Additionally, the controller 160 can have or be in communication with a user interface 168 for displaying system information and receiving inputs from a user. The user interface 168 can be installed locally on the semi-automatic crossbow 100 or be a remotely controlled device such as a mobile device. The user, for example, can view settings or other data of the semi-automatic crossbow 100 on the user interface 168 and input data or commands to the controller 160 via the user interface 168. For example, the user can view tension settings, speed settings, settings for particular bolts, or other settings of the semi-automatic crossbow 100 that can affect how the draw assembly 130 is actuated and the semi-automatic crossbow 100 is cocked and/or fired. For example, the user can input data to the controller 160 via the user interface 168 to change the speed of the draw assembly 130 to either cause the semi-automatic crossbow 100 to reload faster if the user wants to be able to more quickly fire multiple bolts 122 or cause the semi-automatic crossbow 100 to reload slower if the user wants the semi-automatic crossbow 100 to operate more quietly. In other examples, the user can view and change settings via the user interface 168 for a particular type of bolt 122. For example, the user can change the settings of the semi-automatic crossbow 100 when switching between using a bolt 122 with fletching or a bolt 122 that is a sabot round.

Figure 2:
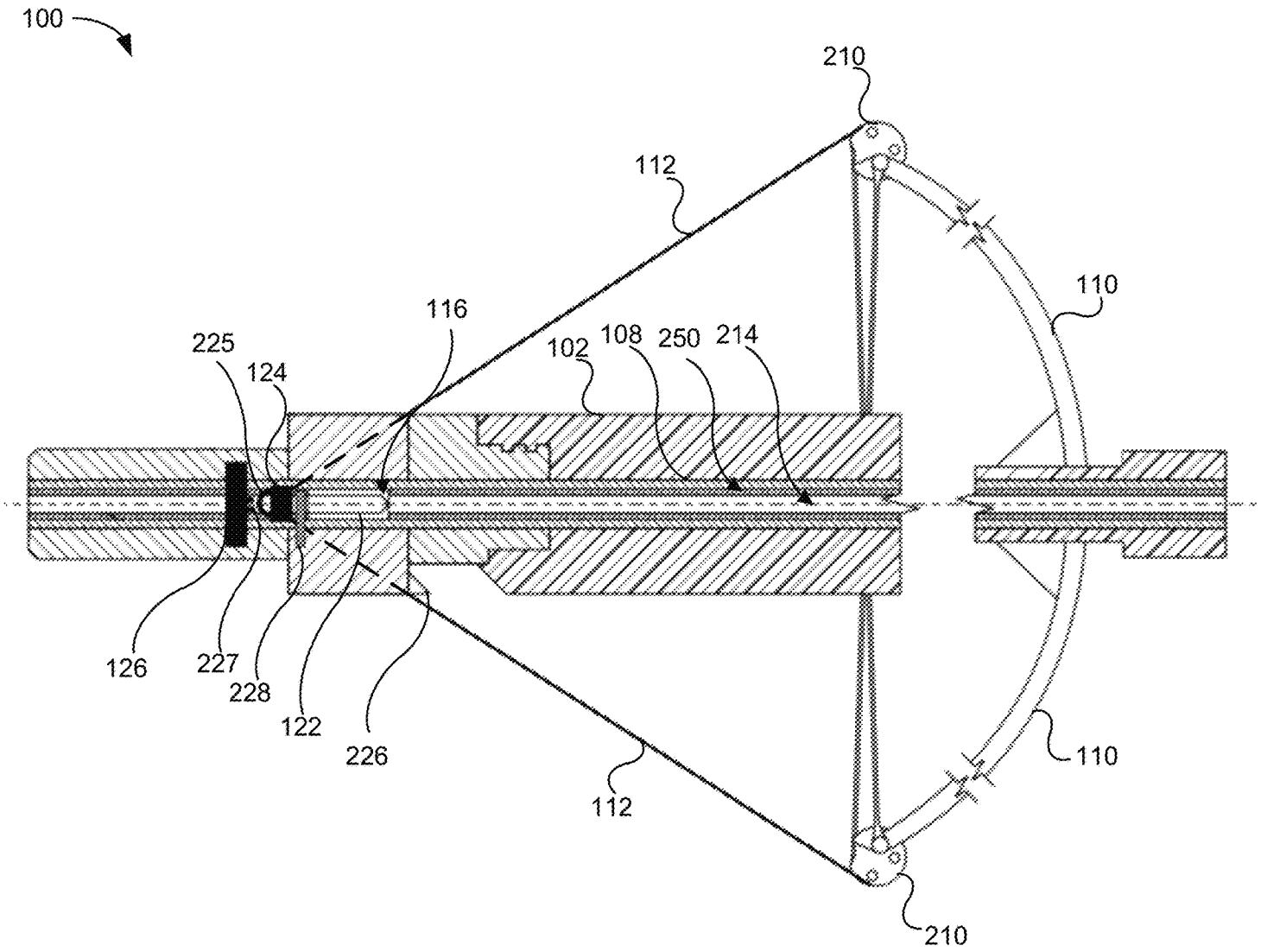
FIG. 2 illustrates a top section view of a semi-automatic crossbow taken along line 2-2 of FIG. 1A, in accordance with the disclosed technology.

FIG. 2 illustrates a top section view of a semi-automatic crossbow 100 taken along line 2-2 of FIG. 1A, in accordance with the disclosed technology. FIG. 2 depicts the semi-automatic crossbow 100 in a cocked position to illustrate the positioning of the various components when in the cocked position. The semi-automatic crossbow 100, when in a cocked position, can have a bolt 122 in the chamber 116 and the truck 124 can be positioned behind the bolt 122 with the drawstring 112 attached and the limbs 110 which can be in a tensioned state. As will be described in greater detail herein, the semi-automatic crossbow 100 can further include a mechanical safety 226 and an electronic safety 228. The mechanical safety 226 and the electronic safety 228 can prevent the semi-automatic crossbow 100 from firing when in cocked position.

As depicted in FIG. 2, the barrel 108 can have a vertical channel 214 configured to receive the truck 124. The vertical channel 214 can be sized such that the truck 124 can move freely through the vertical channel 214 and the bolt 122 can be prevented from falling down into the vertical channel 214. In this way, the truck 124 can move through the vertical channel 214 and the bolt 122 can be directed longitudinally along the length of the barrel 108 by the truck 124 when fired from the semi-automatic crossbow 100.

The barrel 108 can further include rifling 250 that can cause the bolt 122 to rotate as it is directed through the barrel 108. For example, the rifling 250 can engage the bolt 122 as it is projected through the barrel 108 such that the rifling 250 causes the bolt 122 to spin as it moves through the barrel 108 and is projected from the barrel 108. This can be accomplished by the rifling 250 engaging a traditional style bolt 122 with fletching or a bolt 122 that is a sabot round. As will be appreciated, by causing the bolt 122 to rotate as it is directed through the barrel 108, the rifling 250 can cause the bolt 122 to be projected from the semi-automatic crossbow 100 in a more stable manner. The rifling 250 can therefore cause the bolt 122 to fire accurately from the semi-automatic crossbow 100 toward a target. The rifling 250 can comprise grooves or ridges shaped into an inner surface of the barrel 108 in any suitable pattern, frequency, and/or depth.

The limbs 110 can include one or more cams 210 configured to maximize the elastic energy created and stored by the limbs 110. As will be appreciated, the semi-automatic crossbow 100 can comprise a compound bow system. The cams 210 can be configured to reduce the tension applied to the truck 124 when in the cocked position such that the force transferred from the truck 124 to the release 126 is less than would normally be applied to the release 126 when the limbs 110 are in a cocked position without the cams 210.

The truck 124 can further include a release interface 225 configured to be engaged by the release 126. In some examples, the release interface 225 can be a loop or other piece extending from the truck 124 to be engaged or gripped by the release. In this example, the release 126 can further include one or more grips 227 that can engage the release interface 225 and prevent the truck 124 from moving when in a cocked position. The grip 227 can be similar to those commonly used in bow hunting where a clamp pinches together around the release interface 225 and locks in place to prevent movement of the truck 124. The grip 227 can remain in this locked position until the user actuates the trigger and causes the grip 227 to open and release the truck 124 causing the truck 124 to push the bolt 122 outward from the barrel 108. As will be appreciated, the example shown and described in relation to FIG. 2 is merely for explanatory purposes and other release 126 configurations can take the place of those described. For example, the release 126 can be a lever system configured to slide in front of the truck 124 as the truck 124 moves to the cocked position. In this example, the release 126 can be positioned between the truck 124 and the bolt 122 and be configured to rotate or move out of the way of the truck 124 to release the truck 124. Alternatively, or in addition, the release 126 can be positioned as depicted in FIG. 2 and comprise a lever configured to interface with the truck 124 such as a lever configured to rotate and interface with the release interface 225.

To ensure greater safety while using the semi-automatic crossbow 100, the semi-automatic crossbow 100 can have one or more safety mechanisms. For example, the semi-automatic crossbow 100 can have an electronic safety 228 that can be positioned between the truck 124 and the bolt 122 to prevent the semi-automatic crossbow 100 from firing. The electronic safety 228 can be configured to automatically move into a safety position once the truck 124 is moved to a cocked position. Furthermore, the electronic safety 228 can be configured to deactivate or move out of the way of the truck 124 when a user takes the semi-automatic crossbow 100 off safety. The user can, for example, take the semi-automatic crossbow 100 off safety by pressing a button, rotating a lever, or similar actions. Alternatively, or in addition, the electronic safety 228 can be configured to automatically deactivate or move out of the way of the truck 124 when the user grips and raises the semi-automatic crossbow 100 to aim at a target. For example, the electronic safety 228 can be controlled by the controller 160 and the controller 160 can determine that the electronic safety 228 should be actuated from a safety position to a firing position when the user grips and raises the semi-automatic crossbow 100 to aim at a target. In other examples, the controller 160 can be configured with a timer such that the controller 160 can actuate the electronic safety 228 back to a safety position if, after a predetermined length of time, the semi-automatic crossbow 100 has not been fired after the user has actuated the electronic safety from the safety position to the firing position.

The semi-automatic crossbow 100 can include a mechanical safety 226 that can be configured to prevent the semi-automatic crossbow 100 until ready. In some examples, the mechanical safety 226 can be configured to prevent the bolt feeder 120 from delivering a bolt 122 to the chamber 116 until the user is ready to fire the semi-automatic crossbow 100. In other examples, the mechanical safety 226 can be positioned between the truck 124 and the bolt 122 to prevent the semi-automatic crossbow 100 from firing. In yet another example, the mechanical safety 226 can be a mechanical component of the electronic safety 228 and can prevent the electronic safety 228 from deactivating until a user actuates the mechanical safety 226. The mechanical safety 226 can prevent the semi-automatic crossbow 100 from firing until actuated by a user depressing a button, actuating a lever, or other similar actions.

Figure 3:
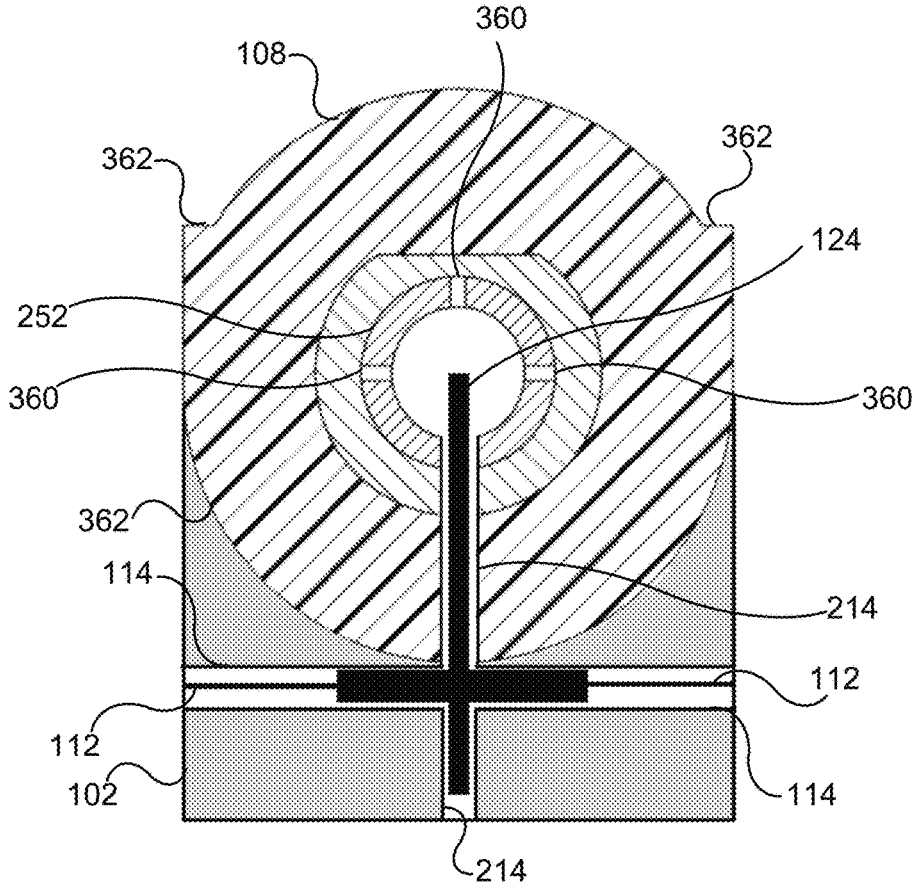
FIG. 3 illustrates front cutaway view of a barrel of a semi-automatic crossbow taken along line 3-3 of FIG. 1A, in accordance with the disclosed technology.

FIG. 3 illustrates front cutaway view of a barrel of a semi-automatic crossbow 100 taken along line 3-3 of FIG. 1A, in accordance with the disclosed technology. In this view, the truck 124 is shown aligned in the vertical channel 214 and the horizontal channel 114. As depicted in FIG. 3, the truck 124 can be attached to the drawstring 112 such that the drawstring 112 is aligned with the truck 124 in the horizontal channel 114. In this way, the drawstring 112 can be attached to the truck 124 and can be configured to transfer the elastic energy from the limbs 110 to the truck 124 when the semi-automatic crossbow 100 is fired. Furthermore, as depicted in FIG. 3, the truck 124 can extend into the barrel 108 such that the truck 124 can engage a bolt 122 (not shown in FIG. 3) to push the bolt 122 from the barrel 108.

The barrel 108 can further include one or more slots 360 configured to receive a fletching of a bolt 122 for bolts 122 that comprise fletching. In this way, the bolt 122 can be maintained in a proper alignment when fired from the semi-automatic crossbow 100. For example, the configuration depicted in FIG. 3 could accommodate a bolt 122 comprising four fletches, three of which can extend into the slots 360 and one of which can extend downwardly into the vertical channel 214. As will be appreciated, the semi-automatic crossbow 100 can be configured to accommodate bolts 122 having more or fewer fletches by having more or fewer slots 360.

As depicted in FIG. 3, the barrel 108 can further include rifling 252 in addition to the slots 360. In this way, the semi-automatic crossbow 100 can accommodate firing bolts 122 with fletching and bolts 122 without fletching. Thus, the bolts 122 without fletching can be caused to spin along a longitudinal axis of the bolt 122 when the bolt 122 is fired from the semi-automatic crossbow 100. Thus, the semi-automatic crossbow 100 can be configured to fire bolts 122 having fletching and bolts 122 not having fletching in a stable and accurate manner.

The semi-automatic crossbow 100 can further include one or more seating surfaces 362 configured to help the barrel 108 seat properly in the stock 102 and the sight 119 to seat properly on the barrel 108. In this way, the semi-automatic crossbow 100 can be configured to ensure the barrel 108 is properly aligned to fire a bolt 122 accurately from the semi-automatic crossbow 100.

Figure 4:
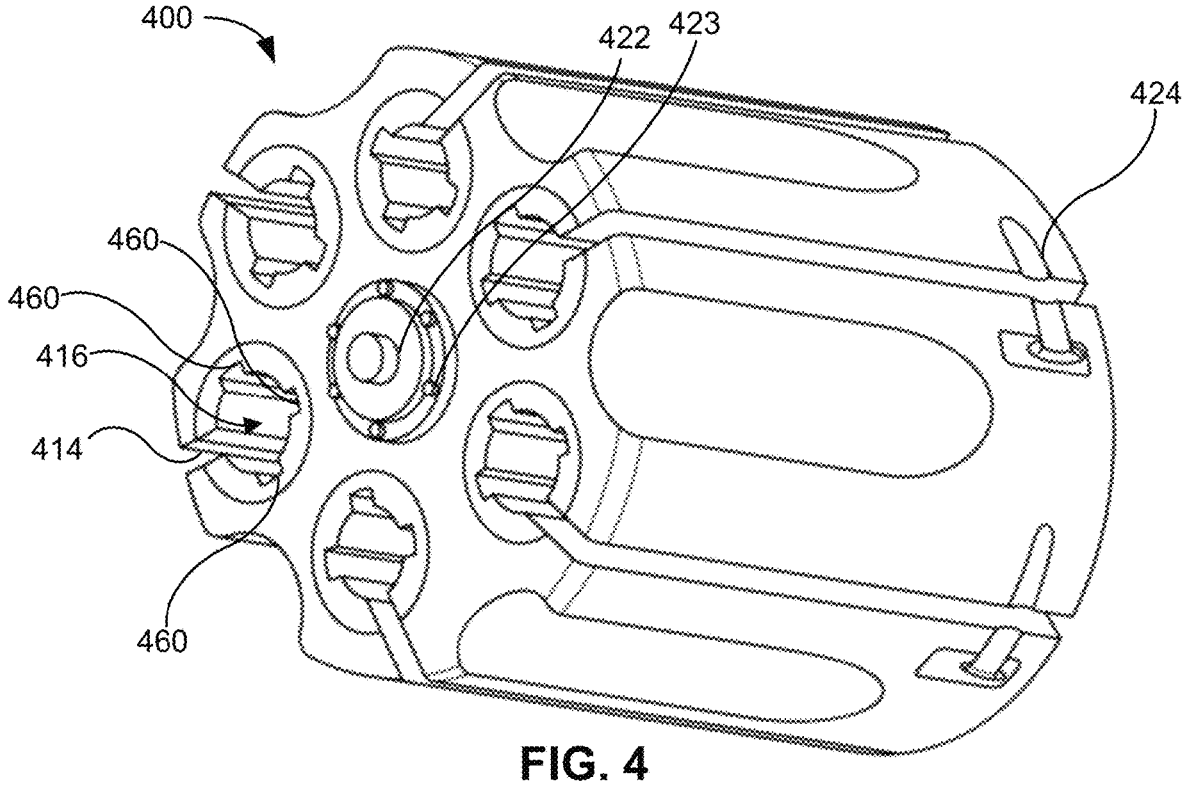
FIG. 4 illustrates a perspective view of a revolving cylinder of a semi-automatic crossbow, in accordance with the disclosed technology.

FIG. 4 illustrates a perspective view of a revolving cylinder 400 of a semi-automatic crossbow 100, in accordance with the disclosed technology. The revolving cylinder 400 can be a specific example of a bolt feeder 120 as previously described. The revolving cylinder 400 can include one or more cylinder chambers 416 configured to receive a bolt 122. The cylinder chamber 416 can be of any suitable diameter and length to accommodate the bolt 122 of the semi-automatic crossbow 100. Furthermore, the revolving cylinder 400 can have multiple cylinder chambers 416 such that the revolving cylinder 400 can be configured to facilitate a user firing multiple bolts 122 from the semi-automatic crossbow 100 before needing to reload. In the example depicted in FIG. 4, the revolving cylinder 400 can be configured to have six cylinder chambers 416. In other examples, the revolving cylinder 400 can have more of fewer cylinder chambers 424 as suitable for the particular application.

The revolving cylinder 400 can further include cylinder slots 460 configured to receive fletches of a bolt 122. The cylinder slots 460 can be configured to align with the slots 360 previously described when the cylinder chamber 416 is aligned with the barrel 108. As will be appreciated, the cylinder slots 460 can be configured to include the same number of cylinder slots 460 as the slots 360 of the barrel 108. The revolving cylinder 400 can also have a cylinder vertical channel 414 configured to align with the vertical channel 214. In this way, the revolving cylinder 400 can be configured to allow the truck 124 to pass back through the cylinder vertical channel 414 when the truck 124 is moved to the cocked position.

The revolving cylinder 400 can include a central axis point 422 configured to allow rotation of the revolving cylinder 400. Furthermore, the revolving cylinder 400 can include one or more rotation notches 423 and rotation grooves 424 that can help to align the revolving cylinder 400 with the chamber 116. In this way, the revolving cylinder 400 can be configured to align one or more bolts 122 with the chamber 116 to facilitate firing of the semi-automatic crossbow 100. The rotation notches 423 and the rotation grooves 424 can be further configured to facilitate rotation of the revolving cylinder 400. In some examples, the revolving cylinder 400 can be rotated into place when the truck 124 is drawn back through the revolving cylinder 400 to a cocked position. For example, as the truck 124 is drawn back through the cylinder vertical channel 414 to the cocked position, the truck 124 can engage the revolving cylinder 400 and/or one or more levers, springs, actuators, or other similar devices to cause the revolving cylinder 400 to rotate into place. In this way, the semi-automatic crossbow 100 can be configured to reload a bolt 122 into the chamber 116 and be ready to fire.

While the present disclosure has been described in connection with a plurality of exemplary aspects, as illustrated in the various figures and discussed above, it is understood that other similar aspects can be used, or modifications and additions can be made to the described aspects for performing the same function of the present disclosure without deviating therefrom. For example, in various aspects of the disclosure, methods and compositions were described according to aspects of the presently disclosed subject matter. But other equivalent methods or composition to these described aspects are also contemplated by the teachings herein. Therefore, the present disclosure should not be limited to any single aspect, but rather construed in breadth and scope in accordance with the appended claims.

What is claimed is:

1. A semi-automatic crossbow comprising:

a stock having a butt end and a fore end;

one or more limbs attached to the stock proximate the fore end, each of the one or more limbs having a proximal end connected to the stock and a distal end terminating at a tip;

a drawstring connected to the one or more limbs proximate the tip of the one or more limbs;

a bolt feeder configured to hold a plurality of bolts simultaneously;

a barrel attached to the stock and configured to direct a bolt of the plurality of bolts from the bolt feeder toward a target, the barrel comprising a channel;

a truck configured to move along the channel of the barrel and to engage the drawstring and the bolt of the plurality of bolts;

a draw assembly configured to automatically move the drawstring to a cocked position, the draw assembly comprising:

a cable;

a hook attached to the cable and configured to extend at least partially into the channel to engage the truck; and an electric motor, the electric motor configured to move the cable to engage the truck with the hook and move the truck with the drawstring to the cocked position; and a release having a trigger and configured to release the truck when the trigger is actuated, wherein the hook is configured to disengage and move out of a pathway of the truck once the release engages the truck such that the truck can be propelled forward by the drawstring when the truck is released by the release.

2. The semi-automatic crossbow of claim 1, wherein the barrel comprises rifling configured to cause the bolt of the plurality of bolts to spin as the bolt of the plurality of bolts is fired from the semi-automatic crossbow.

3. The semi-automatic crossbow of claim 1, wherein the barrel comprises a slot configured to receive a fletching of the bolt of the plurality of bolts.

4. The semi-automatic crossbow of claim 1, wherein the truck is configured to slide along a length of the barrel.

5. The semi-automatic crossbow of claim 4, wherein the bolt feeder comprises a revolving cylinder attached to the stock, the revolving cylinder having a plurality of revolving cylinder chambers, each revolving cylinder chamber of the plurality of revolving cylinder chambers being configured to receive the bolt of the plurality of bolts and comprising a revolving cylinder chamber channel, wherein the chamber channel is configured to receive the truck such that the truck can pass through the revolving cylinder chamber of the plurality of revolving cylinder chambers, and wherein the revolving cylinder chamber channel is configured to align with the channel of the barrel.

6. The semi-automatic crossbow of claim 1, the truck being connected to the drawstring, wherein when the drawstring is moved from a cocked position to a fired position, the drawstring transfers an elastic energy of the one or more limbs to the truck and the truck transfers the elastic energy to the bolt of the plurality of bolts.

7. The semi-automatic crossbow of claim 1, wherein the bolt feeder comprises a revolving cylinder attached to the stock and having a plurality of revolving cylinder chambers, each revolving cylinder chamber of the plurality of revolving cylinder chambers being configured to receive the bolt of the plurality of bolts.

8. The semi-automatic crossbow of claim 7, wherein the revolving cylinder is further configured to automatically rotate the bolt of the plurality of bolts into a firing position prior to the drawstring being released from the release.

9. The semi-automatic crossbow of claim 8, wherein each of the revolving cylinder chambers further comprises a revolving cylinder chamber channel configured to receive the truck, wherein the truck is configured to pass through the revolving cylinder chamber of the plurality of revolving cylinder chambers.

10. The semi-automatic crossbow of claim 1, the bolt feeder comprising a bolt magazine attachable to the stock and configured to receive the plurality of bolts, wherein the bolt magazine is further configured to direct the bolt of the plurality of bolts to a chamber of the semi-automatic crossbow such that the truck can engage the bolt of the plurality of bolts.

11. The semi-automatic crossbow of claim 1, wherein the draw assembly comprises a battery configured to power the electric motor.

12. The semi-automatic crossbow of claim 1, wherein the draw assembly is configured to automatically move the drawstring from a fired position to the cocked position after the bolt of the plurality of bolts has been fired from the semi-automatic crossbow.

13. The semi-automatic crossbow of claim 12, wherein the draw assembly is configured to move the drawstring from the fired position to the cocked position by actuating the electric motor to move the cable and engage the truck with the hook to move the drawstring to the cocked position, and wherein, the release is configured to engage the truck in the cocked position such that the truck is prevented from moving to a fired position until the truck is released by the release.

14. The semi-automatic crossbow of claim 13, wherein the hook is configured to direct the truck through the channel of the barrel until the release engages the truck.

15. The semi-automatic crossbow of claim 1, wherein the draw assembly is configured to operate in reverse to safely move the drawstring from the cocked position to a fired position.

16. The semi-automatic crossbow of claim 1, the release comprising a clamp and the truck comprising a release interface, wherein the clamp is configured to engage the release interface when in a cocked position such that the truck is prevented from moving to a fired position until the trigger of the release is actuated.

17. The semi-automatic crossbow of claim 1, further comprising an electronic safety and a mechanical safety, the electronic safety and the mechanical safety both being configured to prevent movement of the truck.

18. The semi-automatic crossbow of claim 17, wherein the electronic safety is configured to automatically move from a firing position to a safety position after a predetermined length of time.

19. A crossbow comprising:

a stock having a butt end and a fore end;

one or more limbs attached to the stock proximate the fore end, each of the one or more limbs having a proximal end connected to the stock and a distal end terminating at a tip;

a drawstring connected to the one or more limbs proximate the tip of the one or more limbs;

a bolt feeder configured to hold a plurality of bolts simultaneously;

a draw assembly configured to automatically move the drawstring to a cocked position, the draw assembly comprising:

a truck configured to engage the drawstring and a bolt of the plurality of bolts such that the bolt of the plurality of bolts is propelled forward by the truck when the truck is released by a release; and a hook configured to engage the truck to move the truck with the drawstring to the cocked position to engage the truck with the release, and wherein the hook is configured disengaged and to move out of a pathway of the truck once the release engages the truck such that the truck can be propelled forward by the drawstring when the truck is released by the release.

* * * * *